US007139492B2

(12) United States Patent
Mitamura

(10) Patent No.: US 7,139,492 B2
(45) Date of Patent: Nov. 21, 2006

(54) IMAGING FORMING APPARATUS HAVING A PLURALITY OF DISMOUNTABLE UNITS NECESSARY FOR IMAGE FORMING

(75) Inventor: Hiromichi Mitamura, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 1088 days.

(21) Appl. No.: 10/014,165

(22) Filed: Dec. 11, 2001

(65) Prior Publication Data

US 2003/0107783 A1 Jun. 12, 2003

(51) Int. Cl.
*G03G 15/00* (2006.01)

(52) U.S. Cl. ..... 399/12; 399/24; 399/38; 399/110

(58) Field of Classification Search ..... 399/12, 399/111, 113, 115, 116, 110, 119, 24, 25, 399/38

See application file for complete search history.

(56) References Cited

U.S. PATENT DOCUMENTS 5,701,551 A * 12/1997 Honda et al. ..... 399/50
5,812,902 A * 9/1998 Lee ..... 399/25
5,839,018 A * 11/1998 Asanuma et al. ..... 399/43
5,905,008 A * 5/1999 Yoshinaga et al. ..... 430/58.2
6,324,357 B1 * 11/2001 Gomi et al. ..... 399/50
2001/0028802 A1 * 10/2001 Otomo et al. ..... 399/27
2002/0057916 A1 * 5/2002 Yamauchi ..... 399/12

FOREIGN PATENT DOCUMENTS

JP 2001-222204 A 8/2001

* cited by examiner

*Primary Examiner*—Sandra L. Brase
(74) *Attorney, Agent, or Firm*—Frishauf, Holtz, Goodman & Chick, P.C.

(57) ABSTRACT

An image forming apparatus reads the amount of use of each unit from a first storage section which stores the amount of use of each unit. The image forming apparatus reads a condition, set to enable each unit to execute an optimal operation, from a second storage section which stores the condition, on the basis of the read amount of use of each unit, thereby operating each unit under the read condition and executing an image forming operation.

20 Claims, 6 Drawing Sheets

23d

| Setup conditions \ Number of printed sheets | 0 ~ 3000 | 3001 ~ 20000 | 20001 ~ 40000 | 40001 ~ 45000 | 45001 ~ 50000 |
|---|---|---|---|---|---|
| Grid voltage (V) | -650 | -655 | -665 | -680 | -700 |
| Laser power (mW) | 0.30 | 0.31 | 0.33 | 0.36 | 0.40 |

FIG. 6

23e

| Setup conditions \ Number of printed sheets | 0 ~ 10000 | 10001 ~ 20000 | 20001 ~ 30000 |
|---|---|---|---|
| Wire current (μA) | -650 | -670 | -700 |

FIG. 7

23f

| Setup conditions \ Number of printed sheets | 0 ~ 30000 | 30001 ~ 150000 | 150001~ 250000 | 250001~ 280000 | 280001~ 300000 |
|---|---|---|---|---|---|
| Development BIAS voltage (V) | -500 | -505 | -515 | -530 | -550 |
| Mixer rotational speed (rpm) | 200 | 225 | 250 | 275 | 300 |

FIG. 8

IMAGING FORMING APPARATUS HAVING A PLURALITY OF DISMOUNTABLE UNITS NECESSARY FOR IMAGE FORMING

BACKGROUND OF THE INVENTION

1. Field of the Invention

The present invention relates to an image forming apparatus in which a process unit formed of, for example, a unit for forming an image can be exchanged for another.

2. Description of the Related Art

A process unit known from, for example, Japanese Patent Application KOKAI Publication No. P2001-222204A is exchangeable and can be divided into a photosensitive unit and a developing unit. Further, a used process unit can be discriminated from an unused one. While the process unit can be divided into a photosensitive unit and a developing unit, only one counter is employed for counting the number of printed sheets. In this image forming apparatus, if the exchange of one of the units or one component incorporated therein is detected, the counter is reset.

To enable a component such as a photosensitive unit or developing unit to exhibit its best performance, the conditions set for the component are varied in accordance with the amount of use of the component. More specifically, if one of the two units is exchanged as in the case of the aforementioned process units, and the counter is reset, the conditions for both a newly installed unit and the remaining unit are determined on the basis of the reset counter. For example, when the counter has been reset upon the exchange of the photosensitive unit, new conditions based on the reset counter are not optimal for the remaining developing unit, which makes it impossible to execute printing in a best state.

BRIEF SUMMARY OF THE INVENTION

It is an object of the present invention to provide an image forming apparatus in which each component unit used for image forming is operable in an optimal state during its life span, and also an operation method for use in the image forming apparatus.

An image forming apparatus According to an aspect of the invention comprises a plurality of dismountable units necessary for image forming, a first storage section which to stores an amount of use of each unit, a second storage section which stores a condition which enables each unit to execute an optimal image forming operation corresponding to the amount of use of each unit, and a control section which reads the condition from the second storage section, which enables the each unit to execute the optimal image forming operation, on the basis of the amount of use of the each unit stored in the first storage section, thereby operating the each unit under the read condition.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and comprise a part of the specification, illustrate presently embodiments of the invention, and together with the general description given above and the detailed description of the embodiments given below, serve to explain the principles of the invention.

FIG. 6 is a table illustrating examples of optimal conditions, set for the drum unit in the embodiment, corresponding to the respective numbers of printed sheets.

FIG. 7 is a table illustrating examples of an optimal condition, set for the Scorotron charging unit in the embodiment, corresponding to the respective numbers of printed sheets.

FIG. 8 is a table is a table illustrating examples of optimal conditions, set for the developing unit in the embodiment, corresponding to the respective numbers of printed sheets.

DETAILED DESCRIPTION OF THE INVENTION

Embodiments of the invention will be described with reference to the accompanying drawings.

Figure 1:
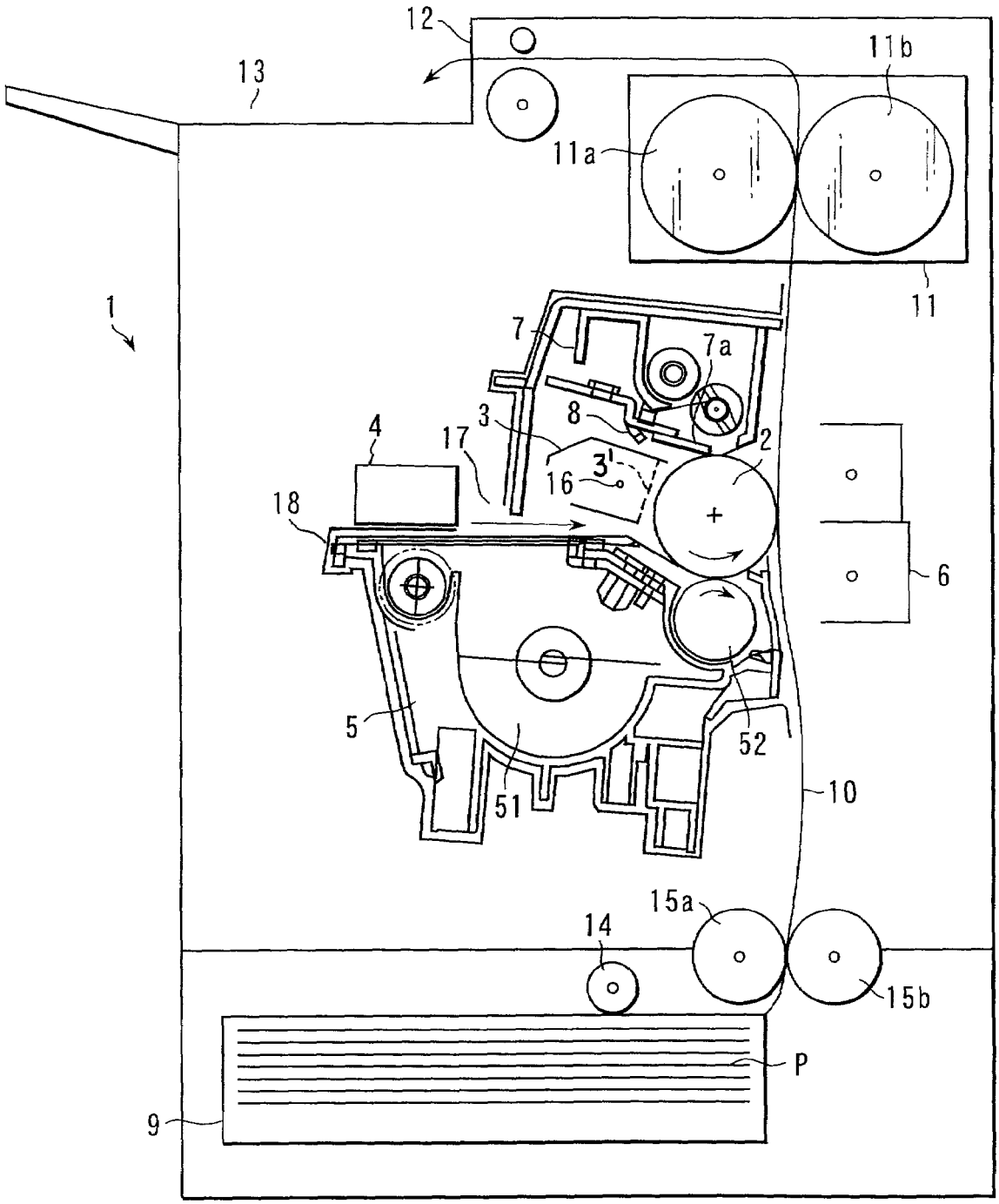
FIG. 1 is a schematic sectional view illustrating the configuration of an image forming apparatus according to an embodiment of the invention.

FIG. 1 schematically shows a section of an image forming apparatus 1. The image forming apparatus 1 includes a negative-charge photosensitive body using a Scorotron charger, and employs reverse developing method using a two-element developer.

A photosensitive drum 2, which rotates counterclockwise in the figure, is provided at a substantially central portion of a cross section of the image forming apparatus 1. Around the photosensitive drum 2, there are provided a Scorotron charging unit 3 as a charging unit, an exposure unit 4, a developing unit 5, a transfer unit 6, a cleaning unit 7 and a discharge LED 8.

Sheets of paper P are contained in a drawable paper cassette 9 provided at the bottom of the image forming apparatus 1. A transport path 10 for the paper sheets P extends from the paper cassette 9 to a paper discharge port 12 between the photosensitive drum 2 and the transfer unit 6 through a fixing unit 11 provided above right of the photosensitive drum 2. The paper sheets P discharged from the paper discharge port 12 are received in a paper receiving section 13. After each paper sheet P is forwarded from the paper cassette 9 to the transport path 10 by a paper feed roller 14, it is guided between the photosensitive drum 2 and transfer unit 6 by transport rollers 15*a* and 15*b* provided with the transport path 10 defined therebetween.

The Scorotron charging unit 3 flows a current to a wire 16 to thereby apply a voltage to a Grid 3', whereby the periphery of the photosensitive drum 2 is uniformly charged with a predetermined potential controlled by the grid-applied voltage.

The exposure unit 4 emits a laser beam to the photosensitive drum 2 in a direction indicated by the arrow in the figure, thereby scanning the periphery of the drum and forming thereon an electrostatic latent image.

The developing unit 5 supplies a developing roller 52, which rotates clockwise in the figure, with a developer 51 supplied from a developer hopper containing the developer 51, thereby converting the electrostatic latent image on the photosensitive drum 2 into a developer image.

The transfer unit 6 transfers, to each paper sheet P, the developer image formed on the photosensitive drum 2.

The cleaning unit 7 cleans the developer 51 remaining on the photosensitive drum 2, using a cleaning blade 7*a*.

The fixing unit 11 includes a heat roller 11*a* containing a heater, and a pressure roller 11*b*, and thermally fix the developer image transferred onto each paper sheet P by the transfer unit 6.

In the image forming apparatus 1, an electrostatic latent image for an image to be printed is formed on the photosensitive drum 2 by emitting a laser beam from the exposure unit 4 to the periphery of the photosensitive drum 2 uniformly charged by the Scorotron charging unit 3, while rotating the drum. The electrostatic image is then converted into a developer image by supplying the developer 51 thereto from the developing unit 5. Further, in the image forming apparatus 1, the paper feed roller 14 and the conveyance rollers 15*a* and 15*b* are rotated in synchronism with the developing operation, thereby conveying each paper sheet P between the photosensitive drum 2 and the transfer unit 6 to perform image transfer. After that, in the image forming apparatus 1, the image transferred to each paper sheet P is thermally fixed thereon by the fixing unit 11, and then each paper sheet P is discharged from the paper discharge port 12. Thus, the image forming apparatus 1 prints an image on each paper sheet P.

The photosensitive drum 2, Scorotron charging unit 3, developing unit 5, cleaning unit 7 and the discharge LED 8 are contained in a process unit 17. The process unit 17 is received in a receiving section 18 contained in the image forming apparatus 1, and fixed therein by a side frame (not shown). Further, the process unit 17 can be detached from the receiving section 18 and exchanged for another.

Figure 2:
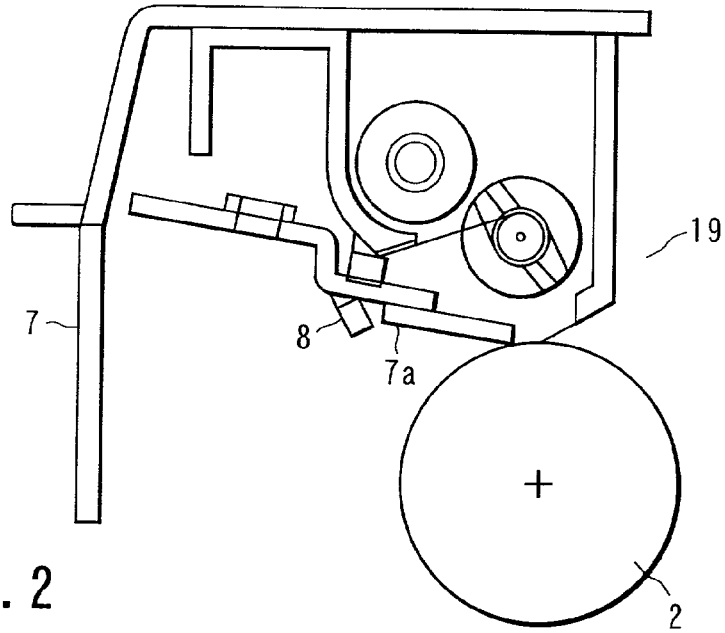
FIG. 2 is a sectional view illustrating a drum unit obtained when a process unit according to the embodiment is disassembled.
Figure 3:
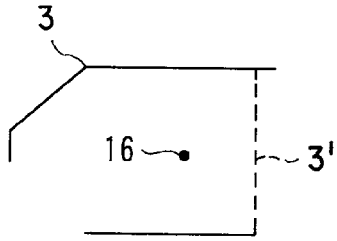
FIG. 3 is a sectional view illustrating a Scorotron charging unit obtained when the process unit according to the embodiment is disassembled.
Figure 4:
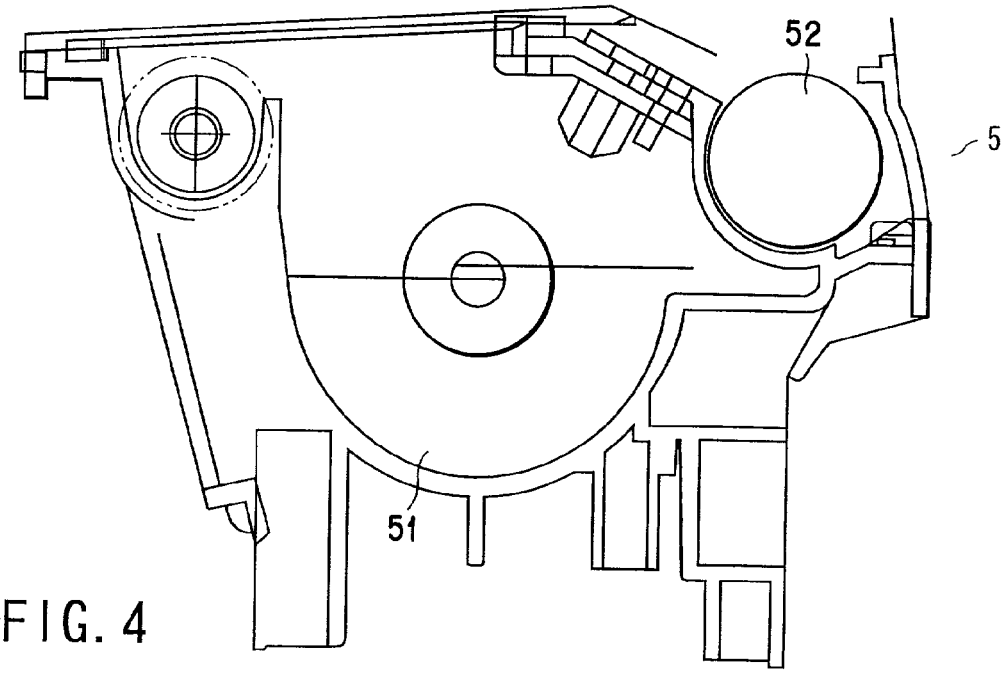
FIG. 4 is a sectional view illustrating a developing unit obtained when the process unit according to the embodiment is disassembled.

FIGS. 2 to 4 show each unit obtained when the process unit 17 is detached from the image forming apparatus 1 and disassembled. FIG. 2 shows a drum unit 19. The drum unit 19 is formed of the photosensitive drum 2, cleaning unit 7 and de-electrifying LED 8, etc. Further, FIG. 3 shows the Scorotron charging unit 3, and FIG. 4 shows the developing unit 5.

Figure 5:
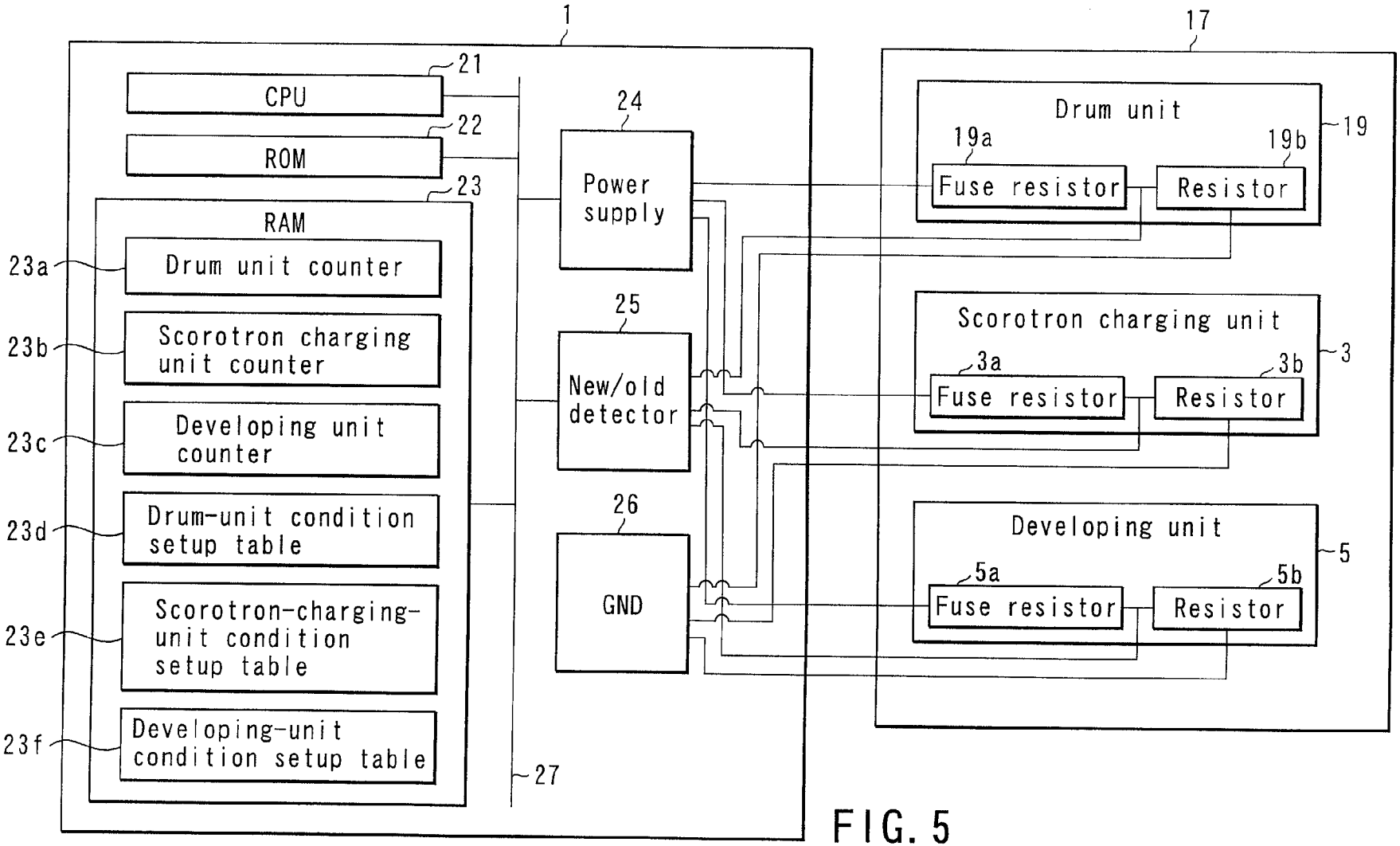
FIG. 5 is a schematic view illustrating a main control block of the image forming apparatus and a detection as to whether or not each unit is a new one when the process unit are housed in the image forming apparatus according to the embodiment.

FIG. 5 is a schematic view showing the main control block of the image forming apparatus and a detection whether or not the drum unit 19, Scorotron charging unit 3 or developing unit 5 is a new one, when the process unit 17 are received in the receiving section 18 of the image forming apparatus 1.

The image forming apparatus 1 is equipped with a CPU 21, a ROM 22, a RAM 23, a power supply unit 24, a new/old detection unit 25 for detecting whether each unit is a new one or an old one, and a GND (grounding) 26 to be grounded. The CPU 21, ROM 22, RAM 23, power supply unit 24 and new/old detection unit 25 are connected to each other by a bus line 27.

Further, when the process unit 17 has been installed into the image forming apparatus 1, the drum unit 19, Scorotron charger unit 3 and developing unit 5 are connected to the power supply unit 24, new/old detection unit 25 and GND 26.

The CPU 21 functions as a controller main body, thereby executing various programs stored in the ROM 22 to control, for example, the printing operation of the image forming apparatus 1.

The RAM 23 includes, as a first storage section, an area assigned to a drum unit counter 23*a* for counting the number of printed paper sheets, which corresponds to the amount of use of the drum unit 19; an area assigned to a Scorotron charging unit counter 23*b* for storing the number of printed paper sheets, which corresponds to the amount of use of the Scorotron charger unit 3; and an area assigned to a developing unit counter 23*c* for storing the number of printed paper sheets, which corresponds to the amount of use of the developing unit 5. Further, the RAM 23 includes, as a second storage section, areas that store respective condition setup tables set for the above units, in which optimal conditions for executing printing operations on the basis of the numbers of printed paper sheets are set for the units, i.e., a drum-unit condition setup table 23*d*, a Scorotron-charging-unit condition setup table 23*e*, and a developing-unit condition setup table. Referring now to FIGS. 6–8, each condition table 23*d*, 23*e* and 23*f* will be described.

FIG. 6 shows an example of the condition setup table 23*d* which corresponds to the cirum unit counter 23*a* and is used for enabling the drum unit 19 to execute an optimal printing operation. In this case, the set values of the Grid voltage (V) and the laser power of the exposure unit 4 are varied in accordance with the number of printed paper sheets stored in the drum unit counter 23*a*. If the number of printed paper sheets is 0–3000, the drum unit 19 operates at a Grid voltage of −650 V, and the exposure unit 4 operates at a laser power of 0.30 nW. If the number of printed paper sheets is 3001–20000, the drum unit 19 operates at a Grid voltage of −655 V, and the exposure unit 4 operates at a laser power of 0.31 mW. If the number of printed paper sheets is 20001–450000, the drum unit 19 operates at a Grid voltage of −665 V, and the exposure unit 4 operates at a laser power of 0.33 mW. If the number of printed paper sheets is 40001–45000, the drum unit 19 operates at a Grid voltage of −680 V, and the exposure unit 4 operates at a laser power of 0.36 mW. If the number of printed paper sheets is 45001–50000, the drum unit 19 operates at a Grid voltage of −700 V, and the exposure unit 4 operates at a laser power of 0.40 mW.

The reason why the Grid voltage of the drum unit 19 and the laser power of the exposure unit 4 are increased in accordance with the increase in the number of printed paper sheets at the drum unit 19 is that the photosensitive layer of the photosensitive drum 2 is ground down due to printing operations, thereby causing a gradual reduction of its charge-holding power and photosensitivity, therefore making it necessary to increase the charging voltage and exposure amount.

FIG. 7 shows an example of the Scorotron-charging-unit condition setup table 23*e* which corresponds to the Scorotron charging unit counter 23*b* and is used for enabling the Scorotron charging unit 3 to execute an optimal printing operation. In this case, the set value of the wire current is varied in accordance with the number of printed paper sheets stored in the Scorotron charging unit counter 23*b*. If the number of printed paper sheets is 1–10000, the Scorotron charging unit 3 operates at a wire current of −650 μA. If the number of printed paper sheets is 10001–20000, the Scorotron charging unit 3 operates at a wire current of −670

μA. If the number of printed paper sheets is 20001–30000, the Scorotron charging unit 3 operates at a wire current of −700 μA.

The reason why the wire current is increased in accordance with the increase in the number of printed paper sheets at the Scorotron charging unit counter 23*b* is that foreign material, such as toner, sticks to the wire 16 due to printing operations, hence making it necessary to increase the current applied to the wire 16 so as to maintain the optimal printing operation of the Scorotron charging unit 3.

FIG. 8 shows an example of the developing unit condition setup table 23*f* which corresponds to the developing unit counter 23*c* and is used for enabling the developing unit 5 to execute an optimal printing operation. In this case, the set values of the developing bias voltage (V) and the rotational speed of the mixer are varied in accordance with the number of printed paper sheets stored in the developing unit counter 23*c*. If the number of printed paper sheets is 0–30000, the developing unit 5 operates at a developing BIAS voltage of −500 V and a mixer rotational speed of 200 rpm. If the number of printed paper sheets is 30001–15000, the developing unit 5 operates at a developing BIAS voltage of −505 V and a mixer rotational speed of 225 rpm. If the number of printed paper sheets is 150001–250000, the developing unit 5 operates at a developing BIAS voltage of −515 V and a mixer rotational speed of 250 rpm. If the number of printed paper sheets is 250001–280000, the developing unit 5 operates at a developing BIAS voltage of −530 V and a mixer rotational speed of 275 rpm. If the number of printed paper sheets is 280001–300000, the developing unit 5 operates at a developing BIAS voltage of −550 V and a mixer rotational speed of 300 rpm.

The reason why the developing BIAS voltage and the mixer rotational speed are increased in accordance with an increase in the number of printed paper sheets at the developing unit counter 23*f* is that the capacity of the developer 51 for charging toner gradually reduces in accordance with degradation of a carrier.

A description will now be given of detection, executed by the new/old detection unit 25, to detect whether each of the drum unit 19, Scorotron charging unit 3 and developing unit 5 is a new one or an old one when the process unit 17 is received in the receiving section 18 of the image forming apparatus 1. As shown in FIG. 5, the drum unit 19, Scorotron charging unit 3 and developing unit 5 are provided with fuse resistors 19*a*, 3*a* and 5*a* and resistors 19*b*, 3*b* and 5*b*, respectively.

When the process unit 17 is received in the receiving section 18 of the image forming apparatus 1, the fuse resistor 19*a* of the drum unit 19, for example, is connected to the power supply unit 24, while a branch of the fuse resistor 19*a* is connected to the resistor 19*b* and another branch is connected to the new/old detection unit 25. Further, the resistor 19*b* is connected to the GND 26 and hence is grounded. Accordingly, when the process unit 17 is received in the image forming apparatus 1, the power supply unit 24 supplies power to the fuse resistor 19*a* of the drum unit 19. Since the resistor 19*b* is connected to the GND 26, a potential difference occurs between the fuse resistor 19*a* and the resistor 19*b*. This means that a current flows from the fuse resistor 19*a* to the resistor 19*b*. If an excessive current flows through the fuse resistor 19*a*, this fuse resistor is heated. If the fuse resistor is heated to a value equal to or more than a predetermined value, the fuse resistor is cut and no more current flows. Thus, after a predetermined current flows, no current flows from the fuse resistor 19*a* to the resistor 19*b*.

In other words, if the new/old detection unit 25 detects the flow of a current when the process unit 17 has been received in the image forming apparatus 1, it detects that the drum unit 19 has been replaced with a new one. Further, if no current flows when process unit 17 has been received therein, the new/old detection unit 25 determines that the drum unit 19 has not been exchanged for a new one.

As with the fuse resistor 19*a* and resistor 19*b* of the drum unit 19, the fuse resistors 3*a* and 5*a* and resistors 3*b* and 5*b* provided in the Scorotron charging unit 3 and developing unit 5, respectively, are to be connected to the new/old detection unit 25 and GND 26.

Thus, when the process unit 17 has been received in the image forming apparatus 1, if the drum unit 19, Scorotron charging unit 3 and/or developing unit 5 is exchanged for a new one, the new/old detection unit 25 can detect it.

Figure 9:
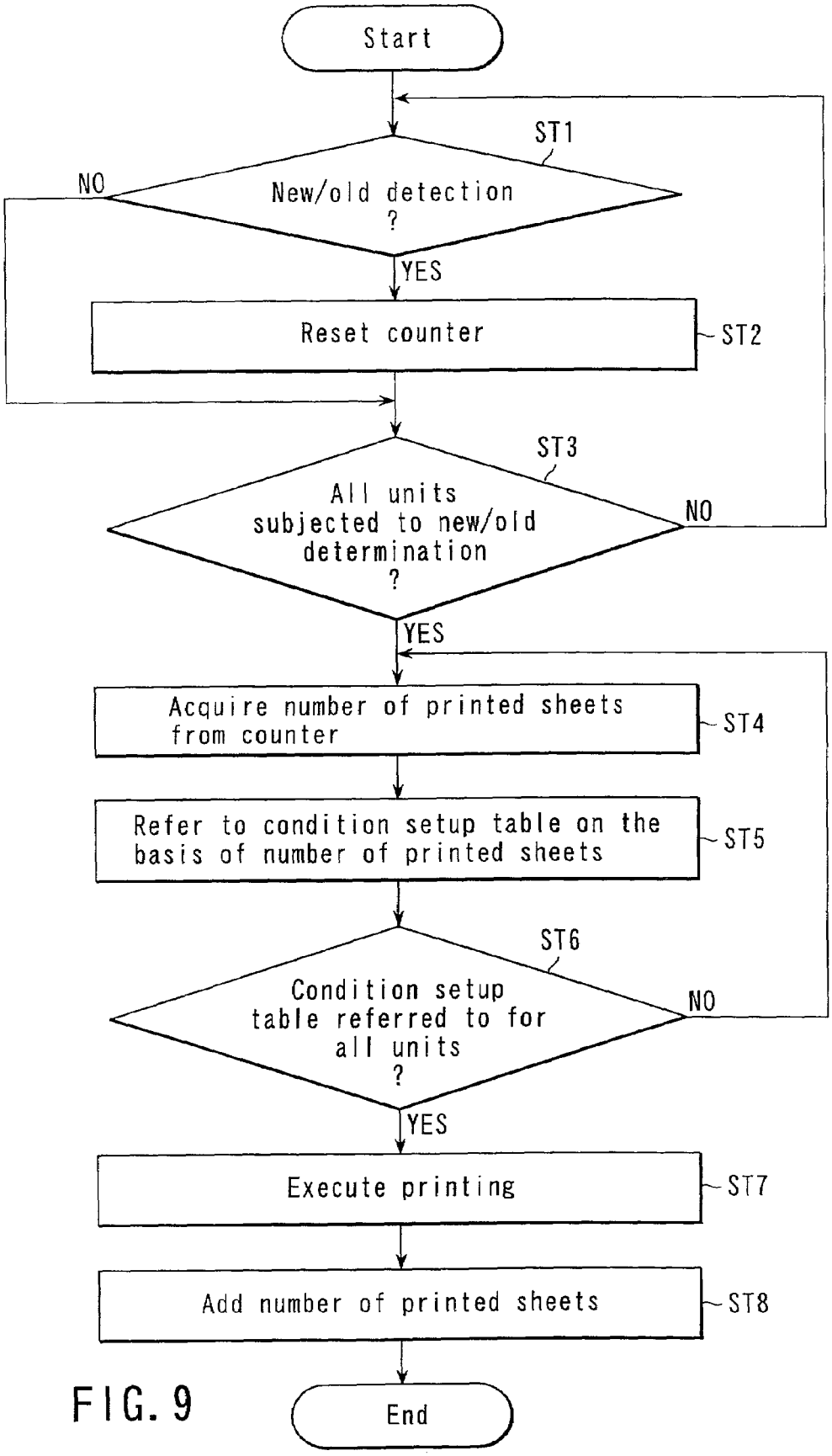
FIG. 9 is a flowchart illustrating a process executed by a CPU in the embodiment.

FIG. 9 is a flowchart illustrating the flow of a printing process executed by the CPU 21. Upon receiving an instruction to execute printing, the CPU 21 starts this process.

At a step ST1, the CPU 21 determines whether or not the new/old detection unit 25 has detected a new unit. If it determines that a new unit has been detected, the CPU resets, at a step ST2, a counter for counting the number of printed paper sheets, which corresponds to the new unit.

If the counter is reset, or if it is determined at the step ST1 that there is no new unit, it is determined at a step ST3 whether or not new/old detection has been executed on all exchangeable units, i.e. the drum unit 19, Scorotron charging unit 3 and developing unit 5.

If new/old determination has not yet been executed on all the units, the program returns to the step ST1, thereby repeating the steps ST1–ST3 until new/old detection is executed on all the units.

After new/old determination is executed on all the units, the number of printed paper sheets is acquired at a step ST4 from a counter in the RAM 23, which stores the number of printed paper sheets. At a step ST5, conditions for a printing operation corresponding to the number of printed paper sheets, are read from a condition setup table for a unit corresponding to the counter.

At a step ST6, it is determined whether or not conditions for the printing operations of all the units have been read. If it is determined that the conditions for the printing operations of all the units have not yet been read from the condition setup tables, the program returns to the step ST4, thereby repeating the steps ST4–ST6 until the setup conditions for the printing operations of all the units are read.

After all the setup conditions for the printing operations are read, printing is executed at a step ST7. At a step ST8, the number of printed paper sheets is added to the count value of each counter, thereby finishing this process.

The operation of the image forming apparatus 1 will now be described. As shown in the condition setup tables 23*d*, 23*e* and 23*f* for the respective units, stored in the RAM 23, the life span of the photosensitive drum 2 of the drum unit 19, as a consumable article, is 50000 sheets in terms of the number of printed paper sheets. Similarly, that of the Scorotron charging unit is 30000 sheets, and that of the developer 51 of the developing unit 5 is 300000 sheets.

When the number of printed paper sheets has reached 50000 and the photosensitive drum 2 has been exchanged for a new one, the once-replaced Scorotron charging unit 3 has already printed 20000 sheets, the drum unit 19 is now a new one, and the developing unit 5 has already printed 50000 sheets. These values are stored in the counters 23*a*, 23*b* and 23*c* for the drum unit 19, the Scorotron charging unit 3 and the developing unit 5. At this time, on the basis of the condition setup tables 23*d*, 23*e* and 23*f* shown in FIGS. 6–8, the drum unit 19 operates at a Grid voltage of −650 V, the exposure unit 4 operates at a laser power of 0.3 mW, the Scorotron charging unit 3 operates at a wire current of −700 μA, and the developing unit 5 operates at a developing BIAS voltage of −505 V and a mixer rotational speed of 300 rpm. In this state, printing is executed under optimal setup conditions.

In this embodiment, even if the drum unit 19, Scorotron charging unit 3 or developing unit 5 incorporated in the process unit 17 is exchanged for a new one, the number of printed paper sheets is stored for each unit, and each unit is operated under optimal conditions corresponding to the stored number of printed paper sheets. Accordingly, the drum unit 19, Scorotron charging unit 3 and developing unit 5 can always operate in an optimal state during their respective life spans, thereby enabling a high-quality image to be always printed.

Further, as the drum unit 19, Scorotron charging unit 3 and developing unit 5 have different life spans, indicated by the number of paper sheets the units can print with their functions maintained, or by the amounts of use of the units, they can be exchanged for a new one at the end of their respective life spans. Thus, the most efficient method of use can be employed, which is economical.

Furthermore, if only components and a fuse resistor, such as the photosensitive drum 2 and the fuse resistor 19*a* included in the drum unit 19, or the developer 51 and the fuse resistor 5*a* included in the developing unit 5, are exchanged for new ones, and the other components of each unit are continued to be used, the drum unit 19 and developing unit 5 can be used more economically.

In the embodiment, the amounts of use of the drum unit 19, Scorotron charging unit 3 and developing unit 5 are determined by counting the respective numbers of printed paper sheets. Further, setup conditions, which correspond to the numbers of printed paper sheets and enable the respective units to execute optimal operations, are read from the condition setup table, thereby operating the units under the read conditions. However, the drum unit 19, for example, may be controlled to execute an optimal printing operation corresponding to the number of rotations of the photosensitive drum 2, by counting and storing, as the amount of use, the number of rotations of the photosensitive drum 2 in place of the number of printed paper sheets, and providing a condition setup table corresponding to the stored number of rotations. Further, in the case of the Scorotron charging unit 3 or developing unit 5, the time taken for printing is measured and stored as the amount of use, and a condition setup table corresponding to the measured time, thereby enabling the Scorotron charging unit 3 or developing unit 5 to execute an optimal printing operation corresponding to the time taken for printing.

Figure 10:
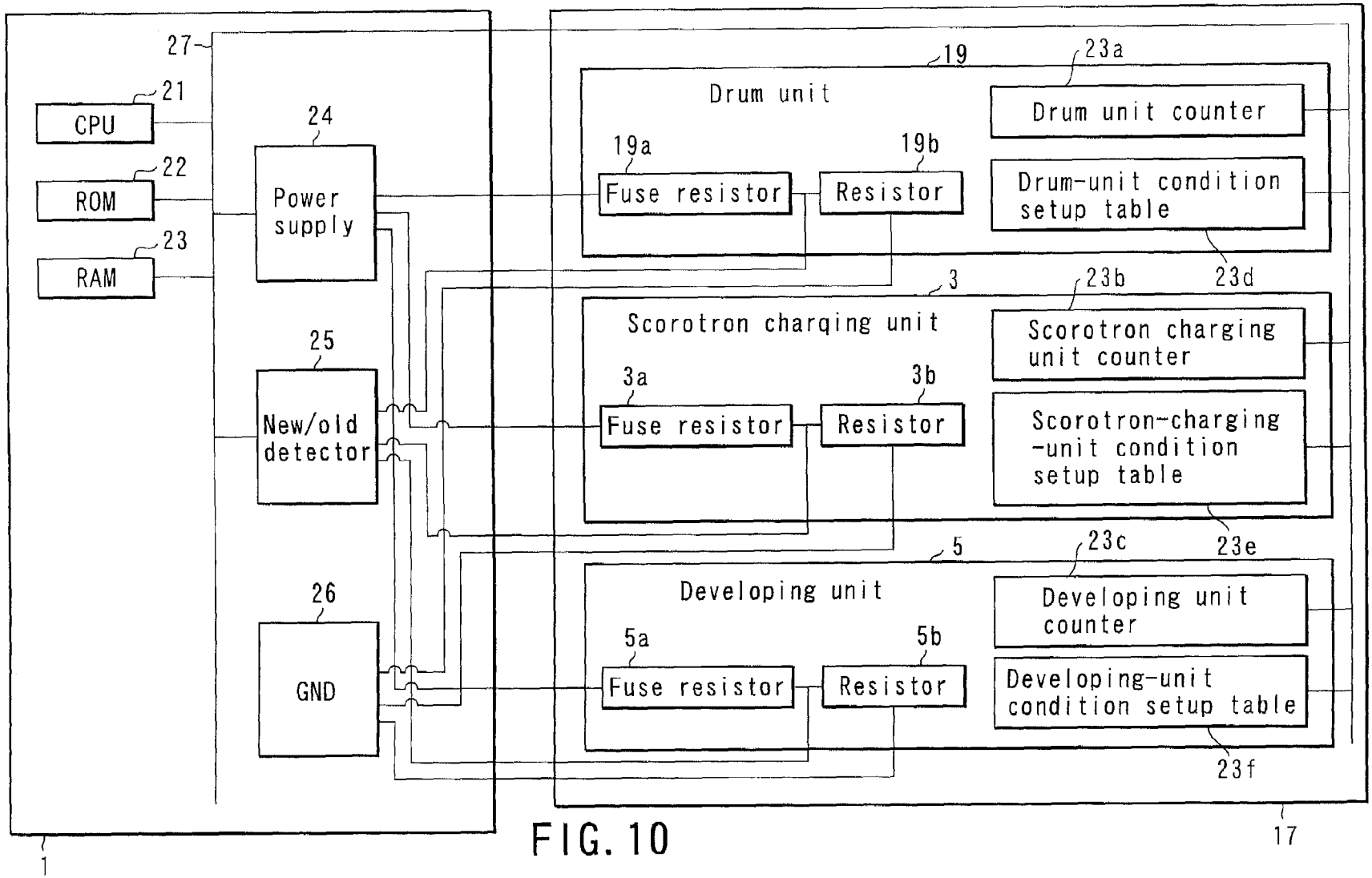
FIG. 10 is a view illustrating a main control block of an image forming apparatus according to another embodiment.

In addition, the image forming apparatus 1 includes the drum unit counter 23*a*, Scorotron charging unit counter 23*b*, developing unit counter 23*c*, drum-unit condition setup table 23*d*, Scorotron-charting-unit condition setup table 23*e* and developing-unit condition setup table 23*f*. However, as shown in FIG. 10, either or both of the counter for counting the amount of use and the condition setup table may be installed in each of the drum unit 19, Scorotron charging unit 3 and developing unit 5, and connected to the bus line 27, whereby the image forming apparatus 1 may execute rewriting and resetting of each counter and reading of setup conditions to thereby control the operations of the drum unit 19, Scorotron charging unit 3 and developing unit 5.

Thus, the provision of a counter for counting the amount of use and a condition setup table in each unit to be exchanged for a new one enables each unit to operate in an optimal state even if each unit is installed in another image forming apparatus.

Also, in the embodiment, the new/old detection unit 25 detects whether the drum unit 19, Scorotron charging unit 3 or developing unit 5 is new or old. This may be modified such that the operator resets the counter for the number of printed paper sheets when each unit is exchanged for another.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a plurality of dismountable units necessary for image forming;

a first storage section which stores an amount of use of each unit;

a second storage section which stores, for each said unit, a respective condition which enables the unit to execute an optimal image forming operation corresponding to the amount of use of the unit; and a control section which reads, for each said unit, the respective condition from the second storage section, which enables the unit to execute the optimal image forming operation, based on the amount of use of the unit stored in the first storage section, thereby operating the unit under the respective read condition.

2. The image forming apparatus according to claim 1, further comprising a detection section which detects whether or not each one of the units is new or old, and wherein when the detection section has detected that any one of the units is new, the control section resets the amount of use of the one said unit stored in the first storage section and then reads the condition which enables the one said unit to execute the optimal image forming operation.

3. The image forming apparatus according to claim 1, wherein one of the units necessary for the image forming comprises a drum unit.

4. The image forming apparatus according to claim 1, wherein one of the units necessary for the image forming comprises a charging unit.

5. The image forming apparatus according to claim 1, wherein one of the units necessary for the image forming comprises a developing unit.

6. The image forming apparatus according to claim 1, wherein the amount of use of said each unit is a number of printed sheets of paper.

7. The image forming apparatus according to claim 1, wherein one said first storage section is provided in each said unit.

8. The image forming apparatus according to claim 1, wherein one said second storage section is provided in each said unit.

9. The image forming apparatus according to claim 1, wherein a life span of each unit is different.

10. The image forming apparatus according to claim 1, wherein one said first storage section and one said second storage section are provided in each unit.

11. A method of operating an image forming apparatus, comprising:

receiving an instruction to form an image;

reading an amount of use of each of a plurality of units from a first storage section which stores the amount of use of each said unit;

reading, for each said unit, a respective condition set to enable the unit to execute an optimal image forming operation, from a second storage section which stores respective conditions set to enable each said unit to execute the optimal image forming operation, based on the amount of use of the unit read from the first storage section.

12. The method of operating the image forming apparatus according to claim 11, further comprising resetting the amount of use stored in the first storage section for one said unit when a detection section which detects whether or not each said unit is new has detected that the one said each unit is new.

13. The method of operating the image forming apparatus according to claim 11, wherein one of the units necessary for the image forming operation comprises a drum unit.

14. The method of operating the image forming apparatus according to claim 11, wherein one of the units necessary for the image forming operation comprises a charging unit.

15. The method of operating the image forming apparatus according to claim 11, wherein one of the units necessary for the image forming operation comprises a developing unit.

16. The method of operating the image forming apparatus according to claim 11, wherein the amount of use of said each unit is a number of printed sheets of paper.

17. The method of operating the image forming apparatus according to claim 11, wherein one said first storage section is provided in each said unit.

18. The method of operating the image forming apparatus according to claim 11, wherein one said second storage section is provided in each said unit.

19. The method according to claim 11, wherein a life span of each unit is different.

20. The method according to claim 11, wherein one said first storage section and one said second storage section are provided in each unit.

* * * * *